US006280481B1

(12) United States Patent
Storey-Laubach et al.

(10) Patent No.: US 6,280,481 B1
(45) Date of Patent: Aug. 28, 2001

(54) SIZING METHODS AND COMPOSITIONS FOR CARBON DIOXIDE DRY CLEANING

(75) Inventors: Bernadette Storey-Laubach, Durham; Karla Litaker, Wake Forest; James DeYoung, Morrisville; Gina Stewart, Durham, all of NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/358,105

(22) Filed: Jul. 21, 1999

(51) Int. Cl.[7] ..... D06L 1/02; D06L 1/08; D06F 43/00

(52) U.S. Cl. ..... 8/142; 8/187; 510/276; 510/285; 510/287; 510/289; 510/290; 510/291

(58) Field of Search ..... 510/276, 285, 510/287, 289, 290, 291; 8/137, 142

(56) References Cited

U.S. PATENT DOCUMENTS

| | | | | |
|---|---|---|---|---|
| 5,683,473 | | 11/1997 | Jureller et al. | 8/142 |
| 5,858,022 | * | 1/1999 | Romack et al. | 8/142 |
| 5,863,298 | * | 1/1999 | Fulton et al. | 8/138 |
| 6,001,133 | * | 12/1999 | DeYoung et al. | 8/142 |

FOREIGN PATENT DOCUMENTS

| | | | |
|---|---|---|---|
| 39 04514 A1 | 8/1990 | (DE) | D06L/1/00 |

OTHER PUBLICATIONS

PCT International Search Report for Int'l Appl'n No. PCT/US00/19420, dated Sep. 14, 2000.

* cited by examiner

*Primary Examiner*—Yogendra N. Gupta
*Assistant Examiner*—Brian P. Mruk
(74) *Attorney, Agent, or Firm*—Myers Bigel Sibley & Sajovec

(57) ABSTRACT

A method for dry-cleaning articles such as fabrics and clothing in carbon dioxide while concurrently applying a sizing agent to the articles comprises contacting an article to be cleaned with a liquid dry cleaning composition for a time sufficient to clean the fabric. The liquid dry-cleaning composition comprises a mixture of carbon dioxide, a surfactant, a sizing agent. An organic co-solvent is preferably included. After the contacting step, the article is separated from the liquid dry cleaning composition. The method is preferably carried out at ambient temperature. Preferred sizing agents are low molecular weight hydrocarbon resins. The surfactant is preferably one that does not contain a $CO_2$-philic group. The organic co-solvent is preferably an alkane and has a flash point above 140° F.

29 Claims, No Drawings

SIZING METHODS AND COMPOSITIONS FOR CARBON DIOXIDE DRY CLEANING

FIELD OF THE INVENTION

The present invention relates to methods and compositions for carrying out the dry-cleaning of fabrics (e.g., garments) in liquid carbon dioxide.

BACKGROUND OF THE INVENTION

Commercial dry cleaning systems currently employ potentially toxic and environmentally harmful halocarbon solvents, such as perchloroethylene. Carbon dioxide has been proposed as an alternative to such systems in U.S. Pat. No. 4,012, 194 to Maffei.

German Patent Application DE3904514 A1 of Schollmeyer, published Aug. 23, 1990, describes a cleaning system combining various conventional anionic or nonionic surface active agents with supercritical $CO_2$. The system described therein appears to combine the detergency mechanism of conventional surface active agents with the solvent power of supercritical fluid carbon dioxide. A carbon dioxide dry cleaning system effective for liquid carbon dioxide is not provided.

U.S. Pat. No. 5,683,473 to Jureller et al. (see also U.S. Pat. No. 5,683,977 to Jureller et al.) describes a dry cleaning system utilizing carbon dioxide in liquid form in combination with surfactants that contain a functional moiety that is $CO_2$-philic, which surfactants are not conventionally used for detergent cleaning. Since there are numerous advantages to employing conventional surfactants (e.g., cost, ready availability, established regulatory approval, established toxicology, etc), it would be extremely desirable to have a dry cleaning system for liquid carbon dioxide that employs conventional surfactants that do not contain a $CO_2$-philic group.

U.S. Pat. No. 5,858,022 to Romack et al. describes dry methods and compositions for dry cleaning in liquid carbon dioxide formulations in which a conventional surfactant (i.e., one that does not contain a $CO_2$-philic group) is used in combination with an organic co-solvent. The conventional surfactant is soluble in the organic co-solvent. Ingredients such as bleaches, whiteners, softeners, sizing, starching, enzymes, hydrogen peroxide or a source of hydrogen peroxide, are described at column 3 lines 39–43, but recommendations for the structure or composition of ingredients that are particularly advantageous in carbon dioxide cleaning formulations, as opposed to functional statements thereof, are not provided.

U.S. Pat. No. 5,863,298 to Fulton et al. suggests methods of sizing and desizing yarn with a liquid carbon dioxide solvent for yarn processing, but does not suggest methods of sizing articles to be cleaned that can be used in a dry cleaning operation. Accordingly, there is a continued for additives or ingredients that can be advantageously employed with carbon dioxide cleaning formulations.

SUMMARY OF THE INVENTION

A method for dry-cleaning garments or fabrics in carbon dioxide, while also applying a sizing agent to the article, comprises contacting a garment or fabric article to be cleaned with a liquid dry cleaning composition for a time sufficient to clean the article, said liquid dry-cleaning composition comprising a mixture of carbon dioxide, surfactant, and a sizing agent. In a preferred embodiment, the sizing agent is a hydrocarbon resin having a molecular weight of from about 500 to about 3000 grams per mole. The contacting step is followed by the step of separating the article from the liquid dry cleaning composition with said sizing agent deposited thereon (preferably at a weight on goods of about 0.05 to about 3 percent).

Preferably, the liquid dry cleaning composition is at ambient temperature, of about 0° C. to 30° C. Preferably, the surfactant is soluble in the co-solvent. The surfactant may or may not be soluble in the $CO_2$. Hence, in one embodiment; the surfactant may contain a $CO_2$-philic group. However, in the preferred embodiment, the surfactant does not contain a $CO_2$-philic group. Hence, an advantage of the present invention is that, by proper use of the co-solvent, conventional surfactants may be employed in a liquid carbon dioxide dry cleaning system.

DETAILED DESCRIPTION OF THE INVENTION

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particular soils (i.e., soils containing insoluble solid components such as silicates, carbon black, etc.).

Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

1. Cleaning Processes.

The present invention may be carried out in any suitable carbon-dioxide based dry cleaning system, such as those described in U.S. Pat. Nos. 5,858,022 to Romack et al. or U.S. Pat. No. 5,683,473 to Jureller et al., the disclosures of which are incorporated by reference herein in their entirety.

Liquid dry-cleaning compositions useful for carrying out the present invention typically include water. The source of the water is not critical in all applications. The water may be added to the liquid solution before the articles to be cleaned are deposited therein, may be atmospheric water, may be the water carried by the garments, etc.

In one embodiment of the invention, better particulate cleaning may be obtained in the absence of water added to the dry-cleaning composition. There is inherently water present on or in the garments or articles to be cleaned as they are placed in the cleaning vessel. This water serves in part to adhere particulate soil to the articles to be cleaned. As the water is removed from the garments into the cleaning composition during the cleaning process, the removal of water from the article to be cleaned facilitates the removal of particulates from the articles to be cleaned. Thus, decreasing the amount of water originally in the cleaning system can serve to facilitate the cleaning of particulate soil from the articles to be cleaned by the action of the water inherently carried by the article to be cleaned.

Liquid dry-cleaning compositions useful for carrying out the present invention typically comprise:

(a) from zero (0), 0.02, 0.05 or 0.1 to 5 or 10 percent (more preferably from 0.1 to 4 percent) water;

(b) carbon dioxide (to balance; typically at least 30 percent);

(c) surfactant (preferably from 0.1 or 0.5 percent to 5 or 10 percent total, which may be comprised of one or more different surfactants); and (d) from 0.1 to 50 percent (more preferably 1, 2 or 4 percent to 30 percent) of an organic co-solvent.

(e) a sizing agent (discussed below), preferably in an amount of from about 0.1% to 25%, preferably between 1 and 5%. Percentages herein are expressed as percentages by weight unless otherwise indicated.

The composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g., (gamma)butyrolactone, (epsilon)caprolactone, and (delta) dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) and polydimethylsiloxanes (e.g., decamethyltetrasiloxane, decamethylpentasiloxane, and hexamethyldisloxane), etc.

Any surfactant can be used to carry out the present invention, including both surfactants that contain a $CO_2$-philic group (such as described in PCT Application W096/27704) linked to a $CO_2$-phobic group (e.g., a lipophilic group) and (more preferably) surfactants that do not contain a $CO_2$-philic group (i.e., surfactants that comprise a hydrophilic group linked to a hydrophobic (typically lipophilic) group). A single surfactant may be used, or a combination of surfactants may be used.

Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin derivatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinamates and derivatives, taurates, thio and mercapto derivatives, tridecyl and dodecyl benzene sulfonic acids, etc.

Additional examples of surfactants that can be used to carry out the present invention include alcohol and alkylphenol polyalkyl ethers(e.g., TERGITOL 15-S-3™ secondary alcohol ethoxylate, TRITON X-207™ dinonylphenol ethoxylate, NEODOL 91-2.5™ primary alcohol ethoxylate, RHODASURF BC-410™ isotridecyl alcohol ethoxylate, RHODASURF DA-630™ tridecyl alcohol ethoxylate) alkylaryl carbonates, including salts and derivatives thereof (e.g., acetic acid, MARLOWET 4530™ dialkylphenol polyethylene glycol acetic acid, MARLOWET 1072™ alkyl polyethylene glycol ether acetic acid), alkoxylated fatty acids (e.g., NOPALCOL 1-TW ™ diethylene glycol monotallowate, TRYDET 2600™ polyoxyethylene (8) monostearate), alkylene oxide block copolymers (e.g., PLURONIC™ and TETRONIC™ products), acetylenic alcohols and diols (e.g., SURFYNOL™ and DYNOL™ products), mono- and di-esters of sulfosuccinic acid (e.g., AEROSOL OT™ sodium dioctyl sulfosuccinate, AEROSOL IB-45™ sodium diisobutyl sulfosuccinate, MACKANATE DC-50™ dimethicone copolyol disodium sulfosuccinate, SOLE TERGE-8™ oleic acid isopropanolamide monoester of sodium sulfosuccinate), sulfosuccinamic acid and esters thereof (e.g. AEROSOL 18™ disodium-N-octadecyl sulfosuccinamate, AEROSOL 22™ tetrasodium N-(1,2-dicarboxyethyl)-N octadecyl sulfosuccinamate) sorbitan esters including derivatives thereof (e.g., SPAN 8™ sorbitan monoleate, ALKAMULS 400-DO™ sorbitan dioleate, ALKAMULS STO™ sorbitan trioleate, TWEEN 81™ polyoxyethylene (5) sorbitan monoleate, TWEEN 21 ™ polyoxyethylene (4) sorbitan monolaurate), isothionates including derivatives thereof (e.g., GEROPON AC-270™ sodium cocoyl isothionate), polymeric alkylaryl compounds and lignins, including derivatives thereof (e.g., LIGNOSITE 50™ calcium lignosulfonate), alkylaryl sulfonic acids and salts thereof (e.g., CALIMULSE EM-99™ branched dodecylbenzene sulfonic acid, WITCONATE C-50H™ sodium dodecylbenzene sulfonate, WITCONATE P10-59™ amine salt of dodecylbenzene sulfonate), sulfonated amines and amides (e.g., CALIMULSE PRS™ isopropylamine sulfonate), Betaine and sultaine derivatives, and salts thereof (e.g., lauryl sulfobetaine, dodecyldimethyl(3-sulfopropyl) ammonium hydroxide, FOAMTAIN CAB-A™ cocamidopropyl betaine ammonium salt, FOAMTAINE SCAB™ cocamidopropyl hydroxy sultaine), e.g., imidazolines including derivatives thereof (e.g., MONOAZOLINE O™ substituted imidazoline of oleic acid, MONOAZOLINE T™ substituted imidazoline of Tall Oil), oxazolines including derivatives thereof (e.g., ALKATERGE E™ oxazoline derivative, ALKATERGE T-IV™ ethoxylated oxazoline derivative), carboxylated alcohol or alkylphenol ethoxylates including derivatives thereof (e.g., MARLOSOL OL7™ oleic acid polyglycol ester), diphenyl sulfonates including derivatives thereof (e.g., DOWFAX™ detergent diphenyl oxide disulfonate, DOWFAX™ dry detergent: sodium n-hexadecyl diphenyl oxide disulfonate, DOWFAX™ Dry hydrotrope: sodium hexyl diphenyloxide disulfonate) fluorinated surfactants (e.g., FLUORAD FC-120™ ammonium perfluoroalkyl sulfonate, FLUORAD FC-135™ fluoroalkyl quaternary ammonium iodides, FLUORAD FC-143™ ammonium perfluoroalkyl carboxylates), lecithins including lecithin derivatives (e.g., ALCOLEC BS™ soy phosphatides), phosphate esters (e.g., ACTRAFOS SA-216™ aliphatic phosphate ester, ACTRAFOS 110™ phosphate ester of complex aliphatic hydroxyl compound, CHEMPHOS TC-310™ aromatic phosphate ester, CALGENE PE- 112N™ phosphated mono- and diglycerides), sulfates and sulfonates of fatty acids (e.g., ACTRASOL PSR™ sulfated castor oil, ACTRASOL SR75™ sulfated oleic acid), sulfates of alcohols (e.g., DUPONOL C™ sodium lauryl sulfate, CARSONOL SHS™ sodium 2-ethyl-1-hexyl sulfate, CALFOAM TLS-40™ triethanolamine lauryl sulfate), sulfates of ethoxylated alcohols (e.g., CALFOAM ES-301™ sodium lauryl ether sulfate), amines, including salts and derivatives thereof (e.g., Tris (hydroxymethyl)aminomethane, ARMEEN™ primary alkylamines, ARMAC HT™ acetic acid salt of N-alkyl amines) amide sulfonates (e.g., GEROPON TC-42™ sodium N-coconut acid-N-methyl taurate, GEROPON TC 270™ sodium cocomethyl tauride), quaternary amines, including salts and derivatives thereof (e.g., ACCOSOFT 750™ methyl bis (soya amidoethyl)-N-polyethoxyethanol quaternary ammonium methyl sulfate, ARQUAD™ N-alkyl trimethyl ammonium chloride, ABIL QUAT 3272™ diquaternary polydimethylsiloxane), amine oxides (e.g., AMMONYX CO™ cetyl dimethylamine oxide, AMMONYX SO™ stearamine oxide), esters of glycerol, sucrose, glucose, sarcosine and related sugars and hydrocarbons including their derivatives (e.g., GLUCATE DO™ methyl glucoside dioleate, GLICEPOL 180™ glycerol oleate, HAMPOSYL AL-30™ ammonium lauroyl sarcosinate, HAMPOSYL M™ N-myristoyl sarcosine, CALGENE CC™ propylene glycol dicaprylate/dicaprate), polysaccharides including derivatives thereof (e.g., GLUCOPON 225 DK™ alkyl polysaccharide ether), protein surfactants (e.g., AMITER LGS-2™ dioxyethylene stearyl ether diester of N-lauroyl-L-glutamic acid, AMISOFT CA™ cocoyl glutamic acid, AMISOFT CS 11™ sodium cocoyl glutamate, MAYTEIN KTS™ sodium/TEA lauryl hydrolyzed keratin, MAYPON 4C™ potassium cocoyl hydrolyzed collagen), and including thio and mercapto derivatives of the foregoing (e.g., ALCODET™ polyoxyethylene thioether, BURCO TME™ ethoxylated dodecyl mercaptan), etc.

Thus the present invention may be carried out using conventional surfactants, including but not limited to the anionic or nonionic alkylbenzene sulfonates, ethoxylated alkylphenols and ethoxylated fatty alcohols described in Schollmeyer German Patent Application DE 39 04514 A1, that are not soluble in liquid carbon dioxide and which could not be utilized in the invention described in U.S. Pat. No. 5,683,473 to Jureller et al. or U.S. Pat. No. 5,683,977 to Jureller et al.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances, etc.

In practice, in a preferred embodiment of the invention, an article to be cleaned and a liquid dry cleaning composition as given above are combined in a closed drum. The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus.

Particularly preferred apparatus for carrying out the present invention, in which sizing can be added in like manner to detergent, is disclosed in commonly owned, copending patent application of James P. DeYoung, Timothy J. Romack, and James B. McClain, Ser. No. 09/312,556, titled Detergent Injection Systems for Carbon Dioxide Cleaning Apparatus, filed May 14, 1999, the disclosure of which is incorporated by reference herein in its entirety.

2. Sizing agents.

As noted above, a sizing agent is preferably added to the cleaning composition during the cleaning step so that the sizing agent is deposited on the articles to be cleaned when they are removed from the cleaning apparatus. As will be appreciated, the sizing agent must be selected so that it is uniformly and cleanly deposited, to impart the desired feel and appearance to the cleaned article, without imparting blemishes or clumps, or rendering the cleaned article unduly rigid.

It has now been found that low molecular weigh hydrocarbon resins are particularly advantageous for use as sizing agents in carbon dioxide cleaning processes. These materials are particularly advantageous because of their solubility in carbon dioxide, combined their relatively high deposition rate on the articles to be cleaned without undue removal or extraction from the articles. Further, these materials are advantageous because, the deposition of relatively low amounts provides the desired feel and appearance to the articles to be cleaned.

In general, low molecular weight hydrocarbon resins are resins characterized by a molecular weight of about 500, 600 or 800 up to about 1500, 2000 or 3000 grams per Mole. In general, such hydrocarbon resins are characterized by a chain length of C4 or C5 to C9 or C10. Suitable resins are available from a variety of sources, such as the ESCOREZ™ hydrocarbon resins available from Exxon Chemical, Houston, Tex., USA, and PICCOTAC B™ , hydrocarbon resin (MW=1650), available from Hercules Inc., Wilmington, Del. USA.

The present invention is explained in greater detail in the following non-limiting examples. In these examples, weight on goods (WOG) is expressed as the percentage increase in weight of the goods resulting from the deposition of size thereon.

EXAMPLE 1

Carbon Dioxide Dry-Cleaning Composition

An additional example of a liquid carbon dioxide dry cleaning system that can be used to carry out the present invention is a mixture that contains:

4.2% ISOPAR M™ organic solvent;

0.24% water;

0.196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 2

Carbon Dioxide Dry-Cleaning Composition

An additional example of a liquid carbon dioxide dry cleaning system that can be used to carry out the present invention is a mixture that contains:

3.07% ISOPAR M™ organic solvent;

1.32% DPMA (diopropylene glycol monomethyl ether acetate);

0.087% water;

0.023% TRITON™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

The liquid dry cleaning systems of Examples 1 and 2 are currently preferred.

EXAMPLE 3

Carbon Dioxide Dry-Cleaning Composition

An additional example of a liquid carbon dioxide dry cleaning system that can be used to carry out the present invention, particularly useful for the cleaning of particulate soil, is a mixture that contains:

4.2% ISOPAR M™ organic solvent;

0.196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 4

Carbon Dioxide Dry-Cleaning Composition

An additional example of a liquid carbon dioxide dry cleaning system that can be used to carry out the present invention, also particularly useful for cleaning particulate soil, is a mixture that contains:

3.07% ISOPAR M™ organic solvent;

1.32% DPMA (diopropylene glycol monomethyl ether acetate);

0.023% TRITON™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

EXAMPLES 5–6

Evaluation of Sizing Agents

The goal of these examples was to evaluate the stability of different sizing materials. Stability was evaluated as a function of concentration and time.

The detergent formulation can be added to the carbon dioxide to provide a dry cleaning formulation in the wash vessel in the form of an aliquot or "pill". The pill is pre-pressurized under a head pressure of carbon dioxide gas to about 700 psi prior to addition to the wash vessel. If it is assumed that the volume of the pill is 1.5 L and the total amount of goods equals 60 lbs. (27 kg), then to achieve a 0.25 % WOG, one would need to add 67.5 g of size to the clothes or 0.045 g size/mL of soap in the pill. Thus:

(0.0025)(27,000g)=67.5 g size;

67.5 g size/1.5L=0.045 g size/mL fluid in the pill.

Initial studies showed that the stability of the sizing materials under pre-pressurization conditions in the cleaning apparatus is inversely proportional to the molecular weight. That is, stability increases with decreasing molecular weight. Three lower molecular weight materials, two C5 hydrocarbon resins (1100 and 1400 g/mole) and a C5–C9 hydrocarbon resin (450g/mol), were used. These materials were various ESCOREZ™ hydrocarbon resins, available from Exxon Chemical, Houston, Tex., USA. As shown below, the C5 hydrocarbon resin, ESCOREZ™ 1580 (MW=1100), is the most stable of the materials evaluated for the length of time that it must sit in the pill (about 20 minutes). These results indicate that the material is stable at a concentration of 0.03 g size/mL ISOPAR M™ solvent, which would deliver approximately 0.17% WOG. Since this WOG seemed small, we wanted to evaluate how much size is extracted from garments after being washed in $CO_2$ to determine how much size should be added. Further experiments indicated that very little size is extracted from garments washed in $CO_2$, unlike perc and petroleum.

EXAMPLE 5

Pre-Pressurization of Various Hydrocarbon Resins

All pre-pressurization experiments were conducted at 17° C. by adding 5 mL of a solution of size in ISOPAR M™ solvent to a 10-mL view cell. A second 10-mL view cell was filled ¾ full with $CO_2$. Vapor side communication was opened between the two cells. T=0 is the time in which the two cells were equilibrated. Results with various potential sizing agents are given in Tables 1–3 below.

TABLE 1

ESCOREZ ™ 2520 C5-9 Hydrocarbon Resin (MW = 450 g/mol).

| Time | 0.01 g size/mL ISOPAR M ™ WOG = 0.06% | 0.02 g size/mL ISOPAR M ™ WOG = 0.11% | 0.04 g size/mL ISOPAR M ™ WOG = 0.22% |
|---|---|---|---|
| T = 0 | Clear with convection currents | Clear with convection currents | Clear with convection currents |
| T = 10 min | Clear with convection currents | Started to form a second phase | 2-phase cloudy top layer, clear bottom layer |
| T = 20 min | 2-phase both layers clear "jelly-like material" on bottom of cell | 2-phase both layers are clear "jelly-like material" on bottom of cell | 2-phase cloudy top layer, clear bottom layer |
| T = 45 min | Phases inverted "jelly-like material" in top layer | 2-phase top layer hazy bottom layer clear | 2-phase cloudy top layer, clean bottom layer |

TABLE 2

ESCOREZ 1580 C5 Hydrocarbon Resin (MW = 1100 g/mol)

| Time | 0.02 g size/mL ISOPAR M ™ WOG = 0.11% | 0.03 g size/mL ISOPAR M ™ WOG = 0.17% | 0.045 g size/mL ISOPAR M ™ WOG = 0.25% |
|---|---|---|---|
| T = 0 | Clear with convection currents | Clear with convection currents | Clear with convection currents |
| T = 30 sec | Clear with convection currents | Clear with convection currents | Hazy |
| T = 1 min | Clear with convection currents | Clear with convection currents | Very cloudy |
| T = 2 min | Clear with convection currents | Clear with convection currents | 2-phase cloudy top layer, clear bottom layer |
| T = 4 min | Clear with convection currents | Clear with convection currents | 3-phase! |
| T = 5 min | Clear with convection currents | Clear with convection currents | 3-phase droplets on window |
| T = 10 min | Clear with convection currents | Clear with convection currents | 2-phase cloudy top layer, clear bottom layer-droplets |
| T = 20 min | Clear with convection currents | Clear with convection currents | 2-phase cloudy top layer, clear bottom layer-droplets |
| T = 45 min | Clear with convection currents | Clear with convection currents | 2-phase cloudy top layer, clear bottom layer-droplets |

TABLE 3

ESCOREZ 1310 LC C5 Hydrocarbon Resin (MW = 1400 g/mol)

| Time | 0.003 g size/mL ISOPAR M ™ WOG = 0.017% | 0.02 g size/mL ISOPAR M ™ WOG = 0.11% | 0.04 g size/mL ISOPAR M ™ WOG = 0.25% |
|---|---|---|---|
| T = 0 | Clear with convection currents | Clear with convection currents | Clear with convection currents |
| T = 30 sec | Clear with convection currents | Clear with convection currents | Clear with convection currents |
| T = 1 min | Clear with convection currents | Clear with convection currents | Cloudy |
| T = 2 min | Clear with convection currents | Clear with convection currents | 2-phase cloudy top layer, murky bottom layer |
| T = 4 min | Clear with convection currents | Clear with convection currents | 3-phase! |

TABLE 3-continued

| ESCOREZ 1310 LC C5 Hydrocarbon Resin (MW = 1400 g/mol) | | | |
|---|---|---|---|
| Time | 0.003 g size/mL ISOPAR M ™ WOG = 0.017% | 0.02 g size/mL ISOPAR M ™ WOG = 0.11% | 0.04 g size/mL ISOPAR M ™ WOG = 0.25% |
| T = 6 min | | | 3-phase droplets on window |
| T = 10 min | Clear with convection currents | Started to form 2-phases | 2-phase clear top layer, cloudy bottom layer-droplets |
| T = 25 min | Started to form 2-phases | 2-phases | 2-phase clear top layer, cloudy bottom layer-droplets |
| T = 35 min | 2 phases cloudy top layer clear bottom phase | 2-phases | 2-phase clear top layer, cloudy bottom layer-droplets |
| T = 45 min | 2-phases clear top layer cloudy bottom layer | 2-phases hazy top layer clear bottom layer | |

EXAMPLE 6

Extraction Experiments

In addition to the stability testing in the view cell, extraction experiments were conducted in a prototype apparatus. Heavily sized fabric sized with partially hydrolyzed poly(vinyl acetate) from wrinkle resistant khaki pants was cut into 4-inch square. These swatches were pre-weighed and washed 4 times using a charge soap that makes up approximately 5% of the $CO_2$-based solvent, as follows:

90.9% Isopar M organic solvent;

1.1% dioctyl sulfosuccinate, sodium salt (AOT- 100);

3.5% Tergitol 15-S-3 surfactant;

0.5% Triton RW-20 surfactant; and 4.0% water.

The swatches were damp coming out of apparatus and were allowed to equilibrate for 24 hours prior to the final weighing and ironing.

It was difficult to quantify the amount of size extracted from the swatches as their weights varied significantly. (Possible sources of error include moisture in the air, time out of the wheel between runs, moisture uptake from the detergent and any soap deposition that may have occurred.) However, there was no apparent difference between swatches washed repeatedly and a virgin swatch. The washed swatches were ironed and appeared to hold a crease as well as the virgin sample.

The foregoing is illustrative of the present invention, and is not to be construed as limiting thereof. The invention is defined by the following claims, with equivalents of the claims to be included therein.

That which is claimed is:

1. A method for dry-cleaning garments or fabrics in carbon dioxide, comprising:

contacting a garment or fabric article to be cleaned with a liquid dry cleaning composition for a time sufficient to clean the article, said liquid dry-cleaning composition comprising a mixture of carbon dioxide, surfactant, and a sizing agent;

wherein said sizing agent is a hydrocarbon resin having a molecular weight of from about 500 to about 3000 grams per mole; and then separating the article from the liquid dry cleaning composition with said sizing agent deposited thereon at a weight on goods of about 0.05 to about 3 percent.

2. A method according to claim 1, wherein said surfactant does not contain a $CO_2$-philic group.

3. A method according to claim 1, wherein said surfactant contains a $CO_2$-philic group.

4. A method according to claim 1, wherein said liquid dry cleaning composition is at a temperature of 0° C. to 30° C.

5. A method according to claim 1, wherein said cleaning composition further comprises an organic co-solvent.

6. A method according to claim 5, wherein said organic co-solvent has a flash point above 140° F.

7. A method according to claim 5, wherein said organic co-solvent is a hydrocarbon co-solvent.

8. A method according to claim 5, wherein said organic co-solvent is an alkane co-solvent.

9. A method according to claim 1, said liquid dry cleaning composition further comprising an alcohol.

10. A method according to claim 1, wherein said contacting step is carried out by jet agitation.

11. A method for dry-cleaning garments or fabrics in carbon dioxide, comprising:

(a) combining a garment or fabric article to be cleaned and a liquid dry cleaning composition in a closed drum so that said closed drum contains both a liquid phase and a vapor phase, said liquid dry cleaning composition comprising a mixture of liquid carbon dioxide, surfactant, and a sizing agent;

wherein said sizing agent is a hydrocarbon resin having a molecular weight of from about 500 to about 3000 grams per mole; then (b) agitating said article in said drum so that said article contacts both said liquid dry cleaning composition and said vapor phase for a time sufficient to clean said article; and then (c) removing the cleaned article from said drum with said sizing agent deposited thereon at a weight on goods of about 0.05 to about 3 percent.

12. A method according to claim 11, wherein said drum is a horizontal rotating drum, and said agitating step is carried out by rotating said drum.

13. A method according to claim 11, wherein said drum is a vertical drum having an agitator positioned therein, and said agitating step is carried out by moving said agitator.

14. A method according to claim 11, wherein said liquid dry cleaning composition is a room-temperature composition and said agitating step is carried out at a temperature of 0° C. to 30° C.

15. A method according to claim 11, wherein said surfactant contains a $CO_2$-philic group.

16. A method according to claim 11, wherein said surfactant does not contain a $CO_2$-philic group.

17. A method according to claim 11, wherein said liquid dry cleaning composition further comprises an organic co-solvent.

18. A method according to claim 17, wherein said organic co-solvent has a flash point above 140° F.

19. A method according to claim 17, wherein said organic co-solvent is an alkane co-solvent.

20. A method according to claim 11, said liquid dry cleaning composition further comprising an alcohol.

21. A liquid dry-cleaning composition, useful for carrying out dry cleaning in carbon dioxide, said composition comprising:

(a) from 0 to 10 percent water;

(b) carbon dioxide;

(c) from 0.1 to 10 percent surfactant;

(d) from 0 to 50 percent of an organic co-solvent; and (e) from 0.1 to 10 percent sizing agent, wherein said sizing agent is a hydrocarbon resin having a molecular weight of from about 500 to about 3000 grams per mole.

22. A liquid dry cleaning composition according to claim 21, wherein said surfactant does not contain a $CO_2$-philic group.

23. A liquid dry-cleaning composition according to claim 21, said composition comprising:

(a) from 0.1 to 4 percent water;

(b) carbon dioxide;

(c) from 0.5 to 5 percent surfactant; and (d) from 4 to 30 percent of an organic co-solvent.

24. A composition according to claim 21, wherein said organic co-solvent has a flash point above 140° F.

25. A composition according to claim 21, wherein said organic co-solvent has a flash point above 170° F.

26. A composition according to claim 21, wherein said organic co-solvent has a flash point above 200° F.

27. A composition according to claim 21, wherein said organic co-solvent is a hydrocarbon co-solvent.

28. A composition according to claim 21, wherein said organic co-solvent is an alkane co-solvent.

29. A composition according to claim 21, further comprising an alcohol.

* * * * *